US006718556B2

(12) United States Patent
Zuckerwar et al.

(10) Patent No.: US 6,718,556 B2
(45) Date of Patent: Apr. 13, 2004

(54) SUPER INSULATED GLOVE/MITTEN WITH ENHANCED TACTILE SENSITIVITY

(76) Inventors: Richard J. Zuckerwar, 268 Strawberry Hill, Gloversville, NY (US) 12078; Eric D. Friedman, 18 Hearthstone Dr., Gansevoort, NY (US) 12831

( * ) Notice: Subject to any disclaimer, the term of this patent is extended or adjusted under 35 U.S.C. 154(b) by 0 days.

(21) Appl. No.: 09/982,153

(22) Filed: Oct. 18, 2001

(65) Prior Publication Data

US 2003/0074713 A1 Apr. 24, 2003

(51) Int. Cl.[7] ..... A41D 19/00
(52) U.S. Cl. ..... 2/164; 2/158; 2/159
(58) Field of Search ..... 2/158, 159, 161.6, 2/164, 163, 167

(56) References Cited

U.S. PATENT DOCUMENTS

| | | | | | |
|---|---|---|---|---|---|
| 2,842,771 | A | * | 7/1958 | Foti | 2/159 |
| 3,114,915 | A | * | 12/1963 | Gross | 2/158 |
| 4,032,990 | A | | 7/1977 | Mandlman | |
| 4,430,759 | A | * | 2/1984 | Jackrel | 2/159 |
| 4,662,006 | A | | 5/1987 | Ross, Jr. | |
| 4,679,257 | A | * | 7/1987 | Town | 2/164 |
| 4,727,602 | A | * | 3/1988 | Giese et al. | 2/163 |
| 4,847,918 | A | * | 7/1989 | Sturm | 2/161.6 |
| 4,918,756 | A | * | 4/1990 | Grilliot et al. | 2/164 |
| 4,995,119 | A | | 2/1991 | Codkind | |
| 5,020,161 | A | * | 6/1991 | Lewis et al. | 2/164 |
| 5,093,933 | A | | 3/1992 | Berry | |
| 5,167,038 | A | * | 12/1992 | Rinehart | 2/164 |
| 5,172,427 | A | | 12/1992 | Van Bergen et al. | |
| 5,236,769 | A | | 8/1993 | Paire | |
| 5,515,547 | A | | 5/1996 | Middleton | |
| 5,542,125 | A | | 8/1996 | Zuckerwar | |
| 5,740,551 | A | * | 4/1998 | Walker | 2/16 |
| 5,832,539 | A | * | 11/1998 | Williams | 2/239 |
| 2002/0174479 | A1 | * | 11/2002 | Markson | 2/161.6 |

FOREIGN PATENT DOCUMENTS

| | | | | |
|---|---|---|---|---|
| CA | 1283753 | | 5/1991 | |
| DE | 195 12 499 | | 6/1996 | |
| FR | 2 750 828 | A1 | 1/1998 | |
| JP | 06257005 | A * | 9/1994 | A41D/19/00 |

* cited by examiner

*Primary Examiner*—Rodney M. Lindsey
(74) *Attorney, Agent, or Firm*—Dickstein, Shapiro, Morin & Oshinsky, LLP

(57) ABSTRACT

An improved article of hand-wear comprising a mitten or a glove having an additional finger or digital section of insulating material, corresponding to the finger section of the article of hand-wear. The article comprises: (a) an inner lining that is preferably moisture absorbent, into which the hand is inserted; (b) an insulating lining made of micro-fibers covering the inner lining; (c) a second insulating micro-fiber ""pouch"" or ""cap"" (hereinafter also ""macrocap"") over the integral fingers or digital section into which the first micro-fiber lining and inner lining is inserted; and (d) an outer cover covering all of the above.

9 Claims, 2 Drawing Sheets

SUPER INSULATED GLOVE/MITTEN WITH ENHANCED TACTILE SENSITIVITY

FIELD OF THE INVENTION

This invention relates to an article of manufacture. More specifically, this invention relates to an article of clothing in the form of hand-wear (i.e., a mitten or glove) having both enhanced insulation (e.g., fleece fiberfill or comparable insulating materials) for protection from the cold, and yet permits improved tactile sensation without exposure of the hand or fingers to the ambient environment.

BACKGROUND OF THE INVENTION

Cold weather greatly increases the rate at which our bodies lose heat to their surroundings. It is a well-known fact that when you get cold your body's extremities lose heat and circulation first. Our bodies conserve the temperature at the center by reducing the blood flow to the arms and legs. In effect, the critical central temperature of our torsos, which contain all of our vital organs, is maintained at the expense of the extremities.

Therefore, it is vital to keep the extremities of a wearer warm in order to avoid a drop in body temperature in cold weather (for our purposes, only hand-wear covering the fingers will be discussed). Hand-wear, in the form of gloves and mittens, have long been the choice of wear in cold weather, but it is an on-going struggle to balance the hand-wear's warmth-retaining qualities with the loss of dexterity because of increased insulation. Notwithstanding the advances in the fabrics and insulating liners used in their manufacture, the increase in the cold insulation properties for have generally come at the expense of loss of tactile sensation through the garment and/or increased overall bulkiness and loss of comfort for the wearer.

Numerous attempts to strike a balance between warmth and dexterity for the wearer have been made in the past. These include: U.S. Pat. No. 5,172,427 (to Van Bergen, et al., issued Dec. 22, 1992) relates to a fingerless mitten which allows all the fingers of a hand to reside within a single closeable cavity to capitalize on the benefits of body heat while allowing the fingers to be easily freed from the cavity when the mitten is rolled up onto the sleeve. However, with this design the wearer is either warm, or dexterous, but not both at the same time.

U.S. Pat. No. 5,515,547 (to Middleton, issued May 14, 1996) relates to an integral mitten/glove combination wherein the palm portion thereof is a fully functioning glove, while the back portion thereof is a fully functioning mitten. According to Middleton, when the ambient environment becomes increasingly cold, the hand is simply withdrawn from the finger webbing that defines the glove, and inserted into the integrated mitten portion thereof, without the hand leaving the warmth of the combined (multi-purpose) glove. In the preferred embodiments of the Middleton, a Velcro-like fastener is provided on the back-hand section of the glove to retain the mitten portion thereof when not in use. While the wearer retains higher dexterity while wearing only the glove, he loses that when the fingers are covered with the mitten covering. Moreover, the mitten covering does not create an airtight space which retains warmth, and the outer layer of the full-featured glove is not a good insulator, resulting in a highly inefficient design for warmth retainment which is also cumbersome to the wearer.

U.S. Pat. No. 5,542,125 (to Zuckerwar, issued Aug. 6, 1996) relates to a sports glove designed to accept interchangeable finger and mitten caps. This hand-wear comprises an ensemble of two distinct components, a glove body (which fits over the palm and the thumb) and interchangeable finger caps, which conform in design to either a mitten or to a glove. Each of the mitten or glove finger caps can be readily interchanged with one another in the ensemble by simple engagement/disengagement with a releasable fastener on the body of the glove. While this design offers flexibility to the user in choosing between greater warmth (the mitten) or greater dexterity (the glove), the mitten and glove modes remain mutually exclusive.

As is evident from the above discussion of the representative prior art, there is generally a compromise between the desire to maintain warmth in cold weather conditions, and the desire to provide as much tactile sensation as possible through the hand-wear. In each of the examples of the prior art, the expedient selected was to provide for alternative mitten and glove designs within an integrated hand-wear, or, alternatively, for interchangeable finger/mitten caps within a glove or mitten ensemble. Notwithstanding such advancements in hand-wear designs, each of the alternatives suggested above are deficient (and implicitly acknowledge such fact) because the basic design and/or fabrication of such hand-wear perpetuates the striking of a compromise between the dual objectives of warmth and digital dexterity.

Accordingly, there continues to exist a need to provide for both superior cold weather comfort (warmth), while at the same time both preserving the integrity of the cold weather hand-wear and maximizing tactile sensitivity through such hand-wear.

OBJECTS OF THE INVENTION

It is the object of this invention to remedy the above as well as related deficiencies in the prior art.

More specifically, it is the principle object of this invention to provide improved hand-wear having enhanced cold weather protection, comfort, and enhanced tactile sensitivity.

It is another object of this invention to provide improved hand-wear having both cold weather comfort and enhanced tactile sensitivity, wherein the hand is maintained in isolation from the ambient environment.

It is still yet another object of this invention to provide improved hand-wear having cold weather comfort, enhanced dexterity and increased comfort, wherein each of the finger portions of a glove or mitten includes multiple or composite insulating layers, which affords both enhanced cold weather comfort, improved tactile sensitivity, and reduced bulkiness of the hand-wear.

SUMMARY OF THE INVENTION

The above and related objects are achieved by providing an article of hand-wear comprising a mitten or a glove wherein each of said article comprises: (a) an inner lining that is preferably moisture absorbent, into which the hand is inserted; (b) an insulating lining preferably made of fleece, fiberfill or comparable insulating material; (c) a second insulating micro-fiber ""pouch"" or ""cap"" (hereinafter also ""macrocap"") over the integral fingers or digital section into which the first micro-fiber lining and inner lining is inserted; (d) an insulating layer of trapped air formed between the insulating layer and the macrocap; and (e) an outer cover covering all of the above.

Unlike ordinary gloves and mittens of conventional construction and in the prior art discussed above, the hand-wear of this invention is provided with extra insulation only in the areas corresponding to the digital portion thereof, specifically, by fabricating a macrocap from multiple lamina of insulating micro-fibers or comparable materials so as to form air pockets within the resulting macrocap laminate. The insulation is concentrated where it is needed most, at the surface of fingers and thumb, specifically, from the crotch of each digit over the tip of each digit. Thus, optimum protection of the digital portion of the hand from the cold is accomplished without over-insulation of the rest of the hand-wear. This avoids giving the glove un-needed bulk which would result in reduced dexterity, while also preventing sweating of the palms due to over-insulation.

It is noted and emphasized that the hand-wear of this invention does not include any flaps, or permit separation of any of the basic integral components of the hand-wear from one another that would permit exposure/access of the hand from within the hand-wear to the ambient environment. Accordingly, such hand-wear is regarded as an integral and unitary structure which is enclosed within an outer layer.

The advantages of such hand-wear design include the maintenance of the warm air chamber within the hand-wear at all times, while maximizing warmth, comfort and dexterity.

DETAILED DESCRIPTION OF THE INVENTION

The hand-wear garments of this invention comprise the gloves and/or mittens shown in the accompanying Figures. In each instance, the hand-wear includes an integral garment, in the form of a glove or a mitten, that provides essentially continuous protection of the hands of the wearer from the ambient environment (cold, snow etc.). This integral garment is further characterized by the addition of a macrocap insulation layer in the form of a pouch, which conforms in shape for the inside layer to fit snugly into. Thus, the macrocap conforms in design preference to a glove when associated with an integral article of hand-wear in the form of a glove. Similarly, where the hand-wear in is the form of a mitten, the design preference of duplicate finger warmer is in the form of a mitten.

Figure 1:
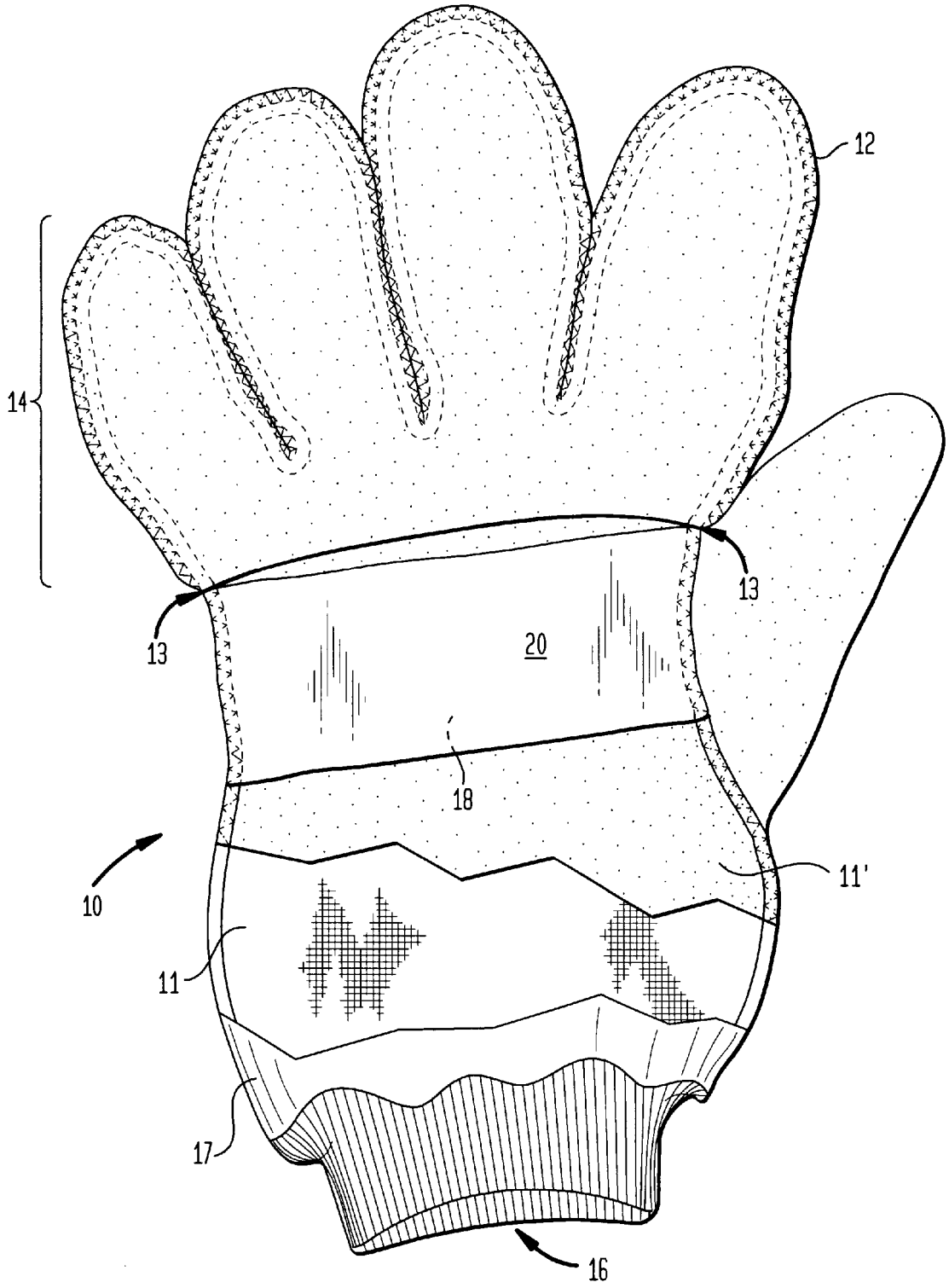
FIG. 1 depicts a back-hand perspective view of a hand-wear garment of this invention in the form of a left glove, with a duplicate finger warmer comprising a macrocap laminate covering the finger portion of a glove.

Turning now to the accompanying Figures, FIG. 1 depicts a back-hand perspective view of an integral glove (10) having an inner cloth lining (11) that is moisture-absorbent and gives the article its shape. A wearer would insert his hand into the inner lining through the open end (16) of the glove. On top of the inner layer is a layer of insulating micro-fibers or fleece ($11^1$) that is preferably sewn directly onto the cloth layer.

Covering the finger portion (14) is a macrocap pouch (12) into which the fingers of the inner layer and insulating layer are inserted. In the glove embodiment, the macrocap pouch has individual digits corresponding to the digits of the hand, and its construction mirrors that of the inner layer and insulating layer, having its own cloth layer (not shown separately) and insulating layer sewn on top. The macrocap pouch is preferably fastened at points (13) to the underlying glove by stitches so the macrocap does not become disengaged by the wearer putting on and taking off the gloves. The entire glove construction is further covered by a water-resistant outer covering (17) that has decorative characteristics. In this embodiment, the finger portion comprises (from the innermost to the outermost) an inner cloth layer, an insulating layer, the macrocap's cloth layer, the macrocap's insulating layer, and the outer cover, The palm and thumb portion comprises an inner cloth layer, an insulating layer, and the outer cover only. Alternatively, the macrocap can also extend to cover the thumb digit. Optionally, an additional internal waterproof and/or waterproof/breathable layer that is located between the water-resistant shell and all the internal insulating layers can be included.

FIG. 1 also depicts a retaining strap (18), which can be made of a resilient elastomeric fabric or material. Moreover, the foregoing arrangement permits the fabrication of this integral garment from more compliant/subtle (less bulky) materials, so as to afford a more sensitive touch/feel of objects through the glove, and thereby enable an individual to perform a number of fine motor skills while his hands remain isolated/protected from the ambient environment.

In another embodiment of the invention, the hand-wear is a integrated mitten having the same general construction and features as the glove described above. The mitten construction also enjoys the benefits of having enhanced warmth, comfort, and maximized dexterity.

Figure 2:
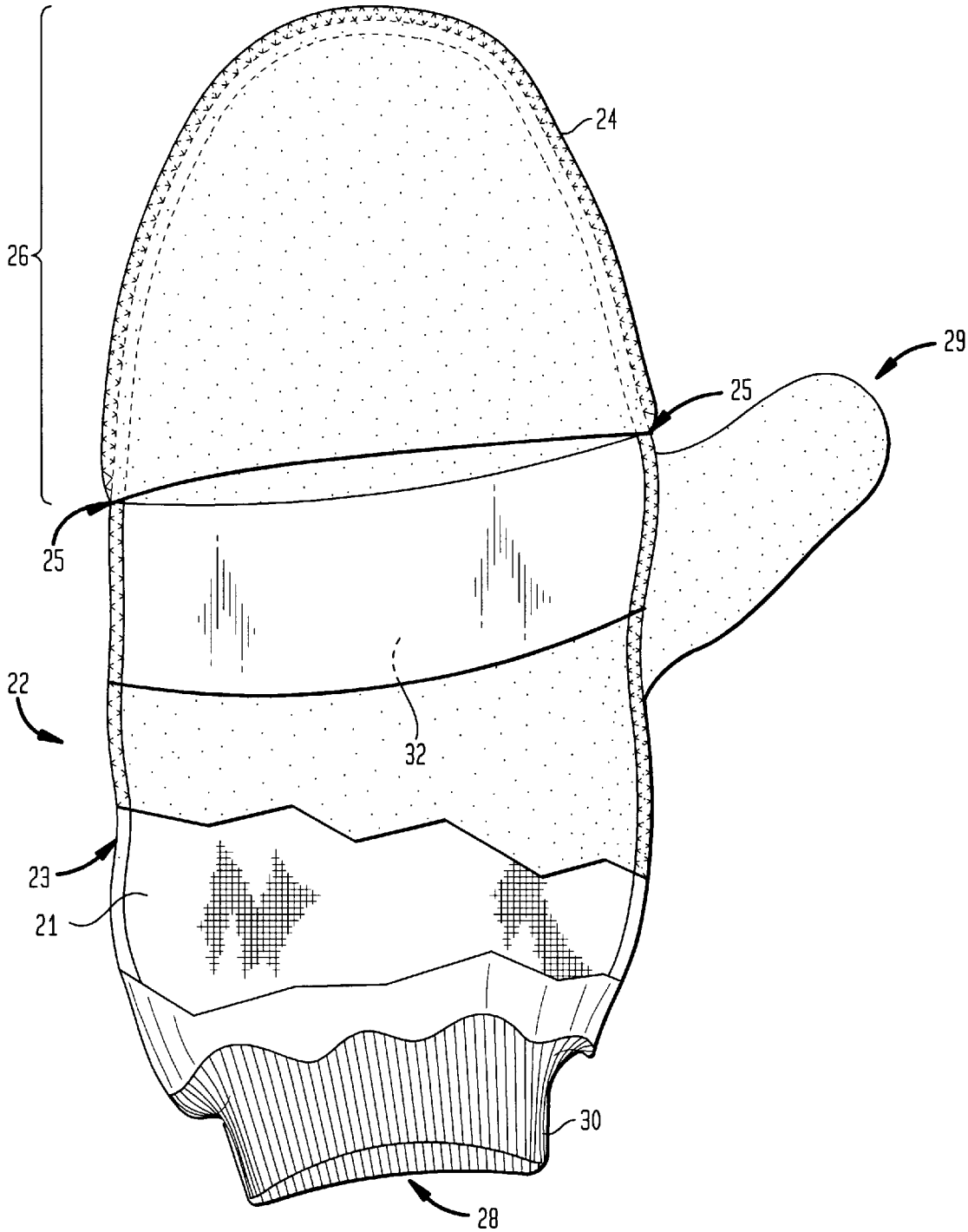
FIG. 2 depicts a back-hand perspective view of a hand-wear garment of this invention in the form of a left mitten, with a duplicate finger warmer covering the finger portion of a mitten.

FIG. 2 depicts a perspective, back-hand view of an integral mitten (22). The mitten, similar to the glove described above, has an inner cloth lining which gives the glove its general shape, and has an opening (28) lined with a stretchable band (30) into which the wearer''s hand is inserted. An insulating layer (23) as described above is sewn on top of the inner layer, and covers the entire mitten. Covering the fingers portion (26) is a macrocap pouch (24) into which the fingers of the inner layer and insulating layer are inserted. As above, the macrocap pouch has a cloth lining (not shown) and an insulating layer on top. The macrocap pouch is fastened at points (25) to the underlying mitten by stitches. The entire hand-wear is covered by a water-resilient outer covering (29) that has decorative features. FIG. 2 also depicts an internal retaining strap (32) which helps hold the shape of the apparel, and is constructed of a resilient elastomeric fabric or material.

In each of the items of hand-wear illustrated in FIGS. 1 and 2, respectively, the macrocap portion (12, 24) of the hand-wear can be stitched from the same or dissimilar materials as the integral hand-wear garment. Materials should be chosen for their exceptional warmth-retaining properties, so as to minimize the bulk. As noted herein, the macrocap laminate is fabricated from layers of micro-fibers or comparable insulating materials. In the preferred embodiments of this invention, the overall shape and appearance of the hand-wear is intentionally exaggerated by the macrocap laminate to add both distinctive appearance and optimum insulating performance, while still maintaining optimal tactile sensation for the wearer.

Further, the hand-wear is preferably constructed with wider sidewalls and fourchettes (i.e., the areas between the fingers) to not only accommodate the increased insulation in these areas, but also to enhance the insulating performance by not restricting the fit and not compressing the insulating loft.

Additional modifications to the preferred embodiments of the invention include different materials choices or fabric treatments to enhance water repellency, or reflective safety strips or alternative means for restraint of the finger warmer portion of the glove upon placement and/or displacement relative to the digital portion of the hand-wear.

What is claimed is:

1. An item of hand-worn apparel comprising:

an inner lining into which the wearer's hand is inserted;

an insulating lining covering the inner lining;

an insulating pouch over only an integral fingers section of said item of hand-worn apparel into which the inner lining and insulating lining is inserted; and an outer cover covering all of the above.

2. The item of hand-worn apparel of claim 1, wherein the apparel is a glove.

3. The item of hand-worn apparel of claim 1, wherein the apparel is a mitten.

4. The item of hand-worn apparel of claims 2 or 3, wherein said insulating pouch is secured to the insulating lining.

5. The item of hand-worn apparel of claims 2 or 3, wherein said insulating pouch comprises a cloth lining and an insulating layer.

6. The item of hand-worn apparel of claim 2, wherein said insulating pouch comprises a digital design corresponding to a glove.

7. The item of hand-worn apparel of claim 3, wherein said insulating pouch comprises a digital design corresponding to a mitten.

8. The item of hand-worn apparel of claims 2 or 3, wherein said insulating pouch covers the fingers and the thumb.

9. The item of hand-worn apparel of claims 2 or 3, further comprising an internal waterproof or waterproof breathable layer that is located between the outer covering and said inner lining.

* * * * *